US011805827B2

(12) United States Patent
Rowe

(10) Patent No.: US 11,805,827 B2
(45) Date of Patent: Nov. 7, 2023

(54) HANDHELD DEMI-FACE SHIELD DEVICE

(71) Applicant: Charles Anna Rowe, Durham, NC (US)

(72) Inventor: Charles Anna Rowe, Durham, NC (US)

( * ) Notice: Subject to any disclaimer, the term of this patent is extended or adjusted under 35 U.S.C. 154(b) by 224 days.

(21) Appl. No.: 17/367,545

(22) Filed: Jul. 5, 2021

(65) Prior Publication Data

US 2022/0030971 A1 Feb. 3, 2022

Related U.S. Application Data

(60) Provisional application No. 62/706,042, filed on Jul. 28, 2020.

(51) Int. Cl.
*A41D 13/11* (2006.01)

(52) U.S. Cl.
CPC ..... *A41D 13/1161* (2013.01); *A41D 13/1184* (2013.01)

(58) Field of Classification Search
CPC ..... A41D 13/1184; A45D 44/12; A41F 11/06; A47G 21/165; A61F 9/06; G02C 5/20; G02C 3/04; A63H 33/12; A63H 33/04; A63H 33/08; A41G 7/00
See application file for complete search history.

(56) References Cited

U.S. PATENT DOCUMENTS 649,421 A * 5/1900 Townsend ..... G02C 3/04 351/56
1,064,430 A * 6/1913 Bernard ..... A61F 9/06 2/11
3,041,624 A * 7/1962 Cutrona, Jr. ..... A41D 13/1184 2/206
5,471,679 A * 12/1995 Paoluccio ..... G02C 11/00 2/9
5,797,141 A * 8/1998 Morlett ..... A45D 44/12 2/9
6,776,483 B1 * 8/2004 Wu ..... G02C 5/2263 351/120

(Continued)

FOREIGN PATENT DOCUMENTS

DE 3713865 A1 * 11/1988 ..... A45D 44/12

OTHER PUBLICATIONS

Machine Translation (German to English) of DE 3713865 A1, provided by EPO (Espacenet). Accessed Apr. 4, 2023. (Year: 2023).*

(Continued)

*Primary Examiner* — Clinton T Ostrup
*Assistant Examiner* — Brianna T. Duckworth
(74) *Attorney, Agent, or Firm* — Tyrrell Ufot; Leandre'a Scott; NCCU IP Clinic

(57) ABSTRACT

A handheld demi-face shield device is easy to use, and can be easily attached and removed from a user's face. The handheld demi-face shield device includes a demi-shield comprising an outer edge, a handle end, a left edge, a right edge, a block end, a bottom portion, and a top portion; a nose bridge, a dowel adapter; and a dowel handle. The nose bridge is removably affixed to demi-shield and the dowel adapter includes a slideable clip, a receiving portion, a face, plurality of dowel holes, a dowel cuff; there is also a dowel handle.

10 Claims, 5 Drawing Sheets

(56) References Cited

U.S. PATENT DOCUMENTS

2008/0121763 A1* 5/2008 Mori ..... H02G 3/32
248/68.1

OTHER PUBLICATIONS

Definition of "Face", provided by Britannica. https://www.britannica.com/dictionary/face. Accessed Apr. 5, 2023. (Year: 2023).*
Definition of "Height", provided by Google (Oxford Languages). Accessed Apr. 5, 2023. (Year: 2023).*

* cited by examiner

HANDHELD DEMI-FACE SHIELD DEVICE

CROSS-REFERENCE TO RELATED APPLICATIONS

This application claims the benefit of U.S. Provisional Application No. 62/706,042, filed on Jul. 28, 2020, which is hereby incorporated in its entirety.

FIELD OF THE INVENTION

The present invention is directed to a face shield device that provides protection against virus-containing aerosolized particles when cloth, surgical masks, or full-face shields are impractical to use. In particular, the present invention is directed to a handheld demi-face shield device.

BACKGROUND OF THE INVENTION

The following description is not an admission that any of the information provided herein is prior art or relevant to the present invention, or that any publication specifically or implicitly referenced is prior art. Any publications cited in this description are incorporated by reference herein. Where a definition or use of a term in an incorporated reference is inconsistent or contrary to the definition of that term provided herein, the definition of that term provided herein applies and the definition of that term in the reference does not apply.

During the COVID-19 pandemic, the Centers for Disease Control and Prevention (CDC) issued guidance relating to customers at restaurants, recommending masks be worn by employees and customers as much as possible when not eating or drinking and when social distancing measures are difficult to maintain. Generally, employees keep a mask on at all times, whereas customers unmask once the food and drinks arrive, or "when not actively eating or drinking". Ultimately, this places the employees who interact with unmasked individuals, as well as other close-by restaurant guests and passers-by, at a greater risk of exposure to the virus. Oftentimes, it can take several seconds for a person to resecure his or her mask and may be impractical by the time a person approaches the table. In another scenario, the customer grabs the mask by the center and holds it in place over his or her nose and mouth with his or her hand. This option is unhygienic and may still result in placing the other person at risk of exposure to the virus. Lastly, speech may be muffled while the customer is wearing his or her mask making it difficult for the others to hear. Sound is further muffled when the table is outside and the voice is competing with the restaurant's music, other conversations close by, and traffic.

For the forgoing reasons, and for other scenarios where a mask is impractical, a need exists for a device that is easy to use, and can be rapidly and easily attached and removed from a user's face.

SUMMARY OF THE INVENTION

The present invention relates to a demi-face shield device that provides a user the ability to hold the mask in front of the face for source-control protection of other persons from particles from the mouth and nose. Furthermore, the device provides self-protection from inhaling particles in an environment where maintaining a safe distance is difficult or undesirable. The present invention is a curved demi-shield frame piece secured by a slidable clip which is in turn snapped onto a dowel adapter. The device contains a plurality of dowel holes configured to connect to the dowel handle in multiple positions to accommodate the user's preference. A fuller size face shield version is configured to extend to provide eye coverage for additional protection against ocular contamination.

In an embodiment, a handheld demi-face shield device comprises a demi-shield comprising an outer edge, a first end, a left edge, a right edge, a second end, a bottom portion, and a top portion; a nose bridge; a dowel adapter; and a dowel handle. In one embodiment, the nose bridge is removably affixed to demi-shield; and in another embodiment, the dowel adapter comprises a slideable clip, a receiving portion, a face, plurality of dowel holes, and a dowel cuff. In one embodiment, the first end is optionally tapered. In another embodiment, the second end is optionally tapered. In yet another embodiment, the first end and the second end are optionally tapered.

In yet another embodiment, the plurality of dowel holes are configured to allow a user to adjust the height of the demi-shield and the angle of the dowel handle to the demi-shield.

In a further embodiment, the face is in the shape of a half-sphere wherein the slideable clip is permanently affixed to a flat side of the face.

In yet another embodiment, the dowel cuff comprises a hollow end and a protruding end wherein the hollow end is capable of receiving the dowel handle and the protruding end is inserted into one of the plurality of dowel holes.

In one exemplary embodiment, the dowel adapter is removably attached to the left edge of the demi-shield using the slideable clip.

The dowel adapter is removably attached to the right edge of the demi-shield using the slideable clip.

In yet another embodiment, the plurality of dowel holes are configured to accommodate varying diameter of the protruding end.

In still another embodiment, the slidable clip is configured to engage varying thicknesses of the demi-shield.

In one embodiment, a handheld demi-face shield device comprises a demi-shield comprising an outer edge, a first end, a left edge, a right edge, a second end, a bottom portion, and a top portion; a nose bridge; a dowel adapter; and a dowel handle. In one embodiment, the nose bridge is removably affixed to demi-shield, and the dowel adapter comprises a slideable clip, a receiving portion, a face, plurality of dowel holes, a dowel cuff. In one embodiment, the dowel cuff comprises a hollow end and a protruding end wherein the hollow end is capable of receiving the dowel handle and the protruding end is inserted into one of the plurality of dowel holes; and the dowel adapter is removably attached to the left edge of the demi-shield using the slideable clip. In one embodiment, the first end and second end are optionally tapered.

In one embodiment, the plurality of dowel holes are configured to accommodate varying diameter of the protruding end.

In another embodiment, the slidable clip is configured to engage varying thicknesses of the demi-shield.

In yet another embodiment, a handheld demi-face shield device comprises a demi-shield comprising an outer edge, a tapered first end, a left edge, a right edge, a tapered second end, a bottom portion, and a top portion; a nose bridge; a dowel adapter; and a dowel handle, wherein the nose bridge is removably affixed to demi-shield; the dowel adapter comprises a slideable clip, a receiving portion, a face, plurality of dowel holes, a dowel cuff, and a dowel handle.

In one embodiment, the dowel cuff comprises a hollow end and a protruding end wherein the hollow end is capable of receiving the dowel handle and the protruding end is inserted into one of the plurality of dowel holes. In another embodiment, the dowel adapter is removably attached to the right edge of the demi-shield using the slideable clip, which is optimally modular, but which may be permanently attached to the semi-sphere.

In one embodiment, the handle end is optionally tapered.

In yet another embodiment, the slidable clip is configured to engage varying thicknesses of the demi-shield.

In a further embodiment, the plurality of dowel holes are configured to accommodate varying diameter of the protruding end.

DETAILED DESCRIPTION

Figure 1:
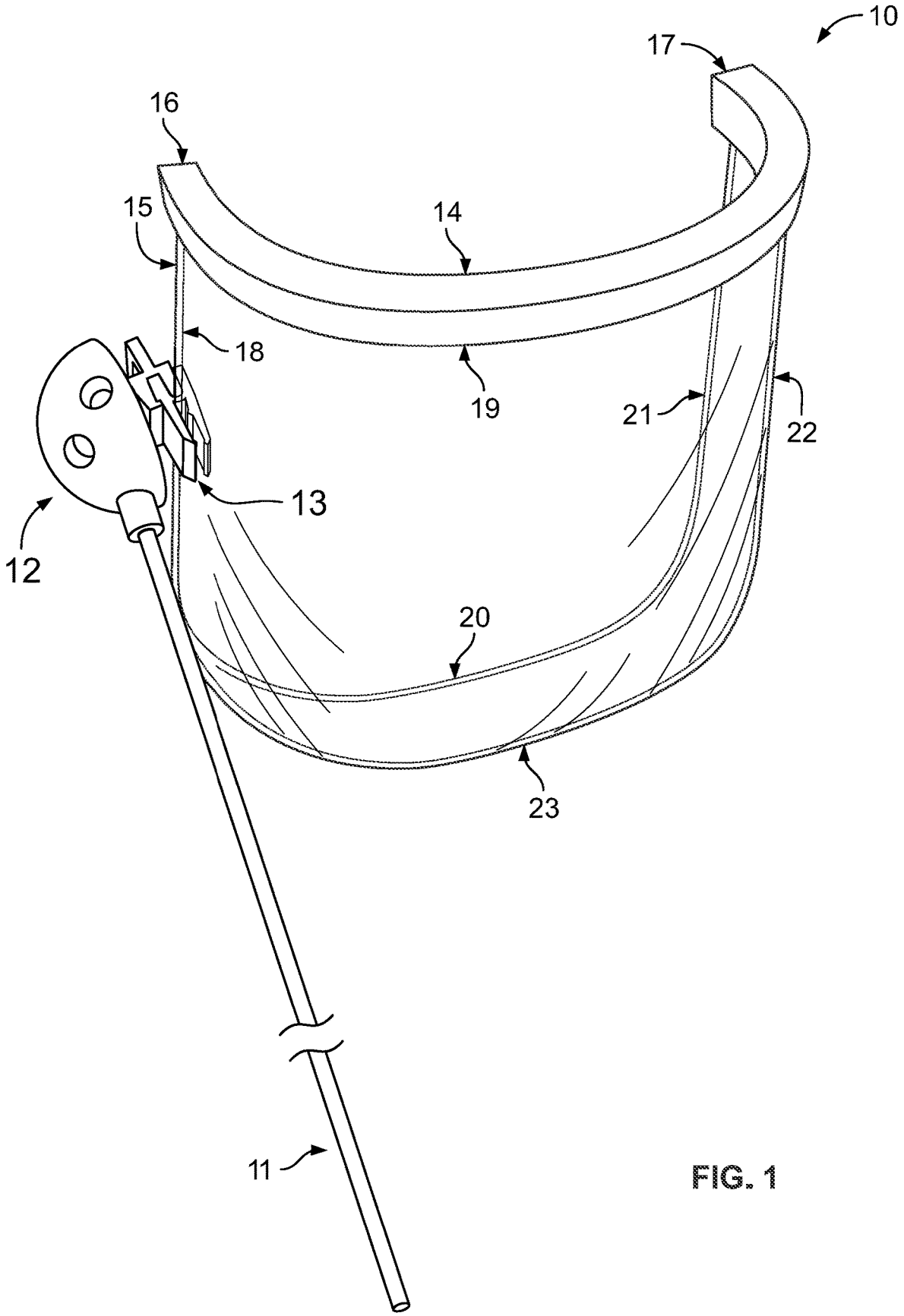
FIG. 1 is an exemplary configuration of a handheld demi-face shield device.

A handheld demi-face shield device is designed and manufactured such that it provides a user with a quick way to cover his or her face when someone is approaching, and as an option to a canonical face mask, which has its own drawbacks (in some cases causing the nose to run, breathing to be more difficult, tickling, itchiness, and/or contact dermatitis, and heat trapping).

As used in the description herein and throughout the claims that follow, the meaning of "a," "an," "and," and "the" includes plural reference unless the context clearly dictates otherwise. Also, as used in the description herein, the meaning of "in" includes "into" and "on" unless the context clearly dictates otherwise.

As used herein, the term "about" in conjunction with a numeral refers to a range of that numeral starting from 10% below the absolute of the numeral to 10% above the absolute of the numeral, inclusive.

Exemplary configurations of the present invention are depicted in FIGS. 1-6, in which handheld demi-face shield device 10 comprises demi-shield 22, nose bridge 14, dowel adapter 12, and dowel handle 11. In an exemplary configuration, demi-shield 22 comprises outer edge 15, first end 16, left edge 18, right edge 21, second end 17, bottom portion 20 and top portion 19. In an embodiment, demi-shield 22 is about 6 inches to about 10 inches long and about 9 inches to about 13 inches wide and is curved along curved edge 23 and nose bridge 14 (see FIG. 1). In another embodiment, demi-shield 22 is of rectangular shape before fitting the nose bridge. One of ordinary skill in the art can envision other shapes for demi-shield as long as it is within the spirit of the present invention and the overall optimal "shielding" function is met. Material of construction for demi-shield 22 is any rigid or semi rigid material such as rigid plant-based material, plastic, Polycarbonate, Polyester (PET) film or any combination thereof. In general, demi-shield 22 is optically clear, lightweight, and comfortable. In one embodiment, demi-shield 22 is opaque. In one embodiment, first end 16 is optionally tapered. In another embodiment, second end 17 is optionally tapered.

Figure 6:
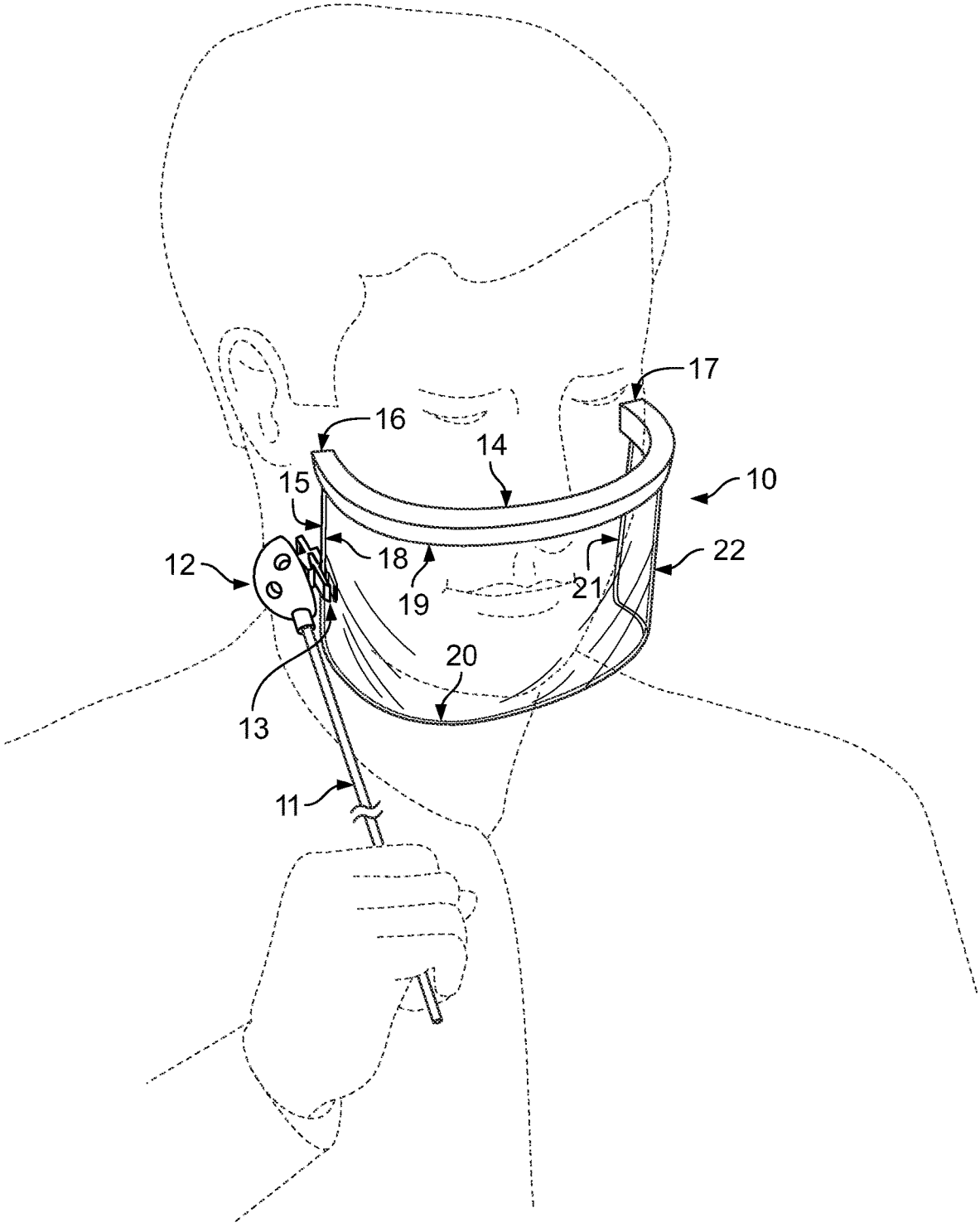
FIG. 6 depicts an exemplary configuration of a handheld demi-face shield device in use.

In an exemplary embodiment, handheld demi-face shield device 10 is configured to be held by a user by holding dowel handle 11 and it can be moved in an upward motion towards the user's face (see FIG. 6).

In one embodiment, nose bridge 14 is about 3 inches to about 10 inches in length and is constructed from any rigid material such as rigid plant material, plastic, Polycarbonate, Polyester (PET) film or any combination thereof.

Figure 2:
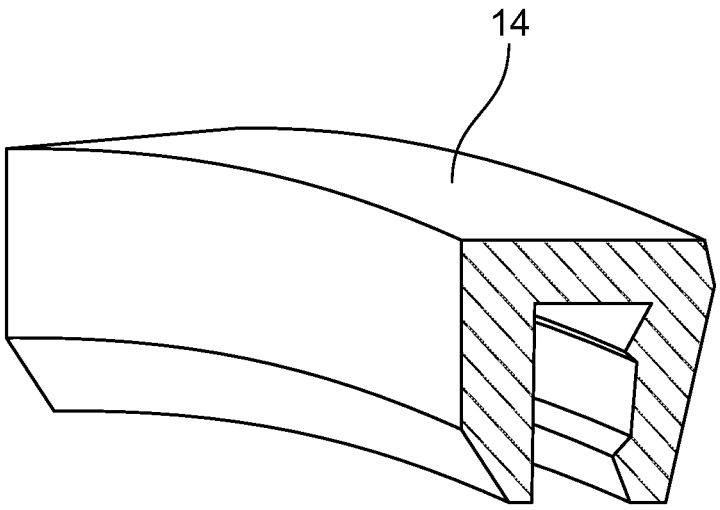
FIG. 2 is an exemplary configuration of a nose bridge of a handheld demi-face shield device.

In one embodiment, nose Bridge 14 is affixed to demi-shield 22 (see FIG. 2). In an embodiment, nose bridge 14 is permanently affixed to demi-shield 22. Yet, in another embodiment, nose bridge 14 is removably affixed to demi-shield 22.

Figure 3:
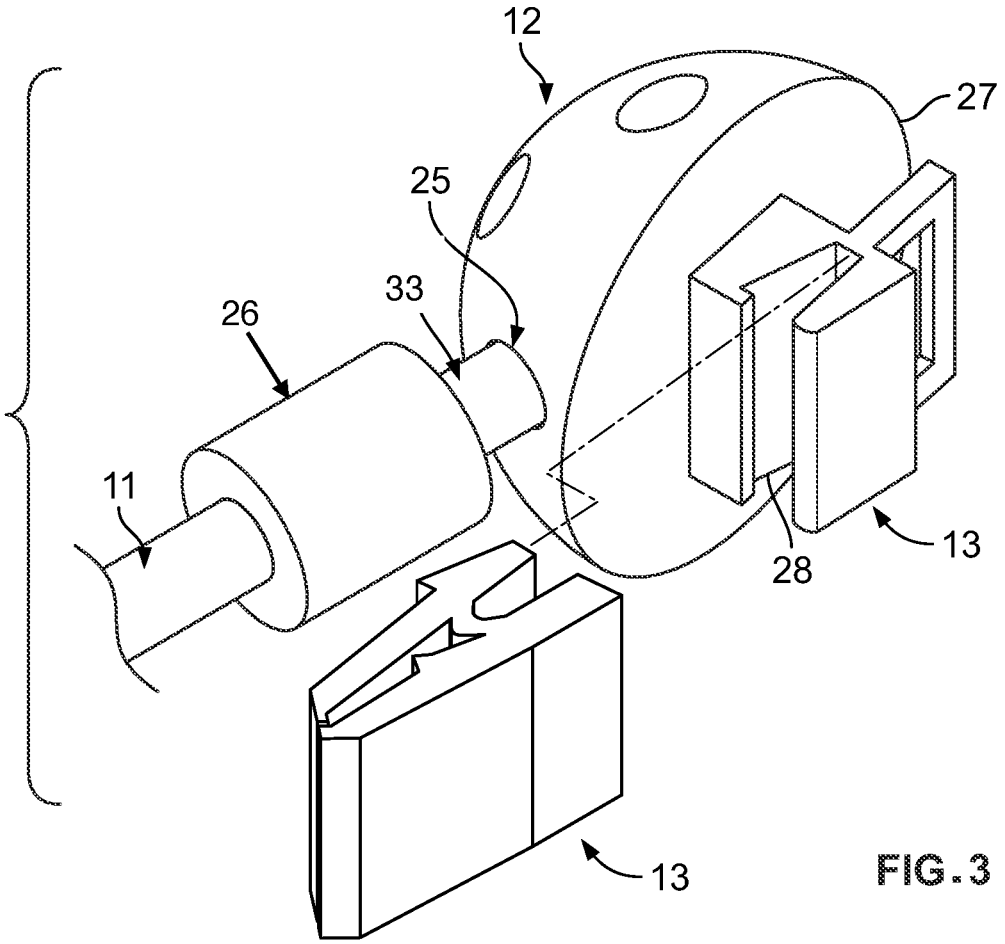
FIG. 3 is an exemplary configuration depicting a perspective view of a dowel adapter of a handheld demi-face shield device.
Figure 4:
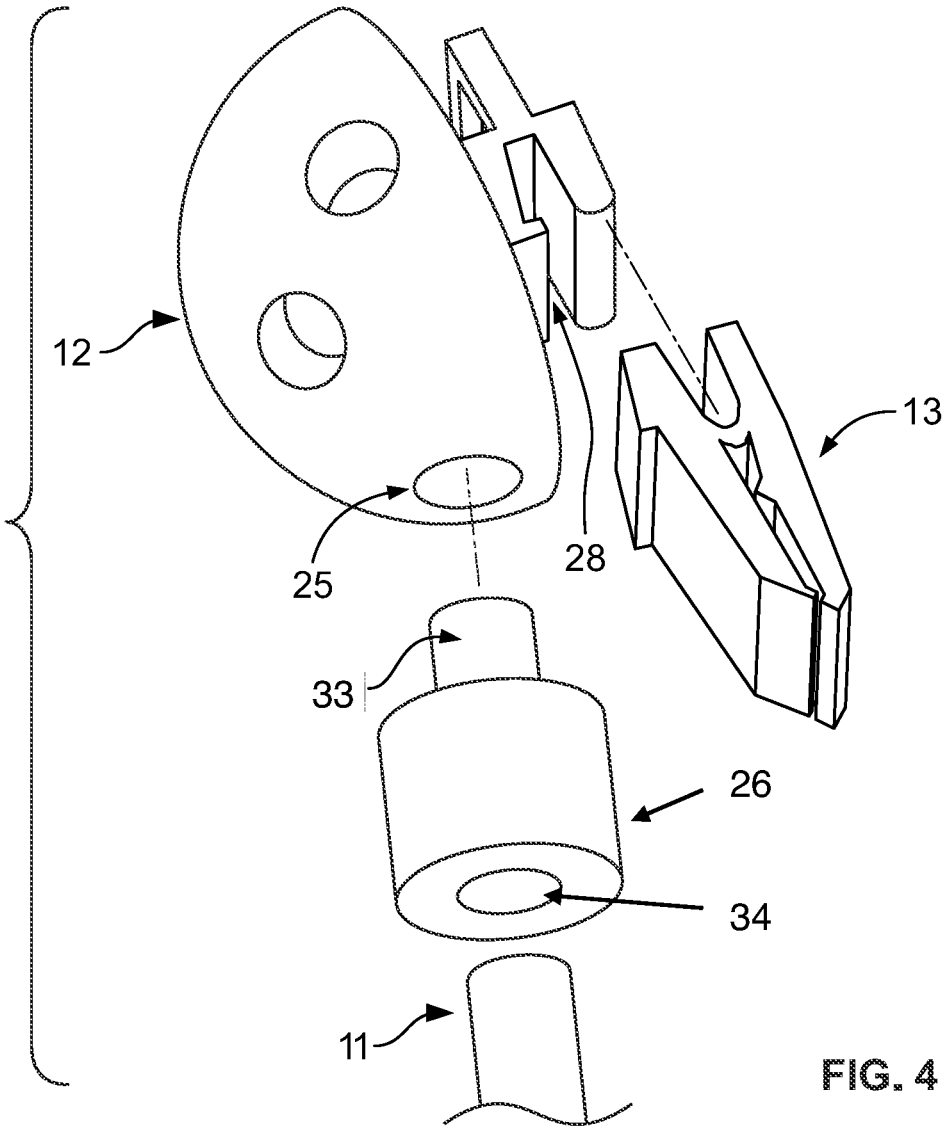
FIG. 4 is an exemplary configuration depicting a side perspective view of a dowel adapter of a handheld demi-face shield device.

In an exemplary embodiment, dowel adapter 12 comprises slideable clip 13, receiving portion 28, face 27, plurality of dowel holes 25, and dowel cuff 26 (see FIGS. 3-4). In one embodiment, plurality of dowel holes 25 are configured to allow a user to adjust the height of demi-shield 22 and the angle of dowel handle 11 to demi-shield 22. In one embodiment, dowel cuff 26 is removable. In an exemplary embodiment, face 27 is in the shape of a half-sphere wherein slideable clip 13 is permanently affixed to the flat side of face 27 (see FIG. 3). In one embodiment, dowel cuff 26 comprises hollow end 34 and protruding end 33 wherein hollow end 34 is capable of receiving dowel handle 11 and protruding end 33 is inserted into one of plurality of dowel holes 25. In an embodiment, dowel adapter 12 is removably attached to left edge 18 of demi-shield 22 using slideable clip 13. In the alternative, dowel adapter 12 is removably attached to right edge 21 of demi-shield 22 using slideable clip 13. In an embodiment, plurality of dowel holes 25 are configured to accommodate varying diameter of protruding end 33. One of ordinary skill in the art can envision a proper location for plurality of dowel holes 25 to accommodate the user preference which is in the scope of the present invention.

In one embodiment, slidable clip 13 is configured to engage varying thicknesses of demi shield 22. For example, thickness of demi-shield 22 may vary from about 0.1 mm to about 0.3 mm. In one embodiment, thickness of demi-shield 22 is about 0.18 mm.

Figure 5:
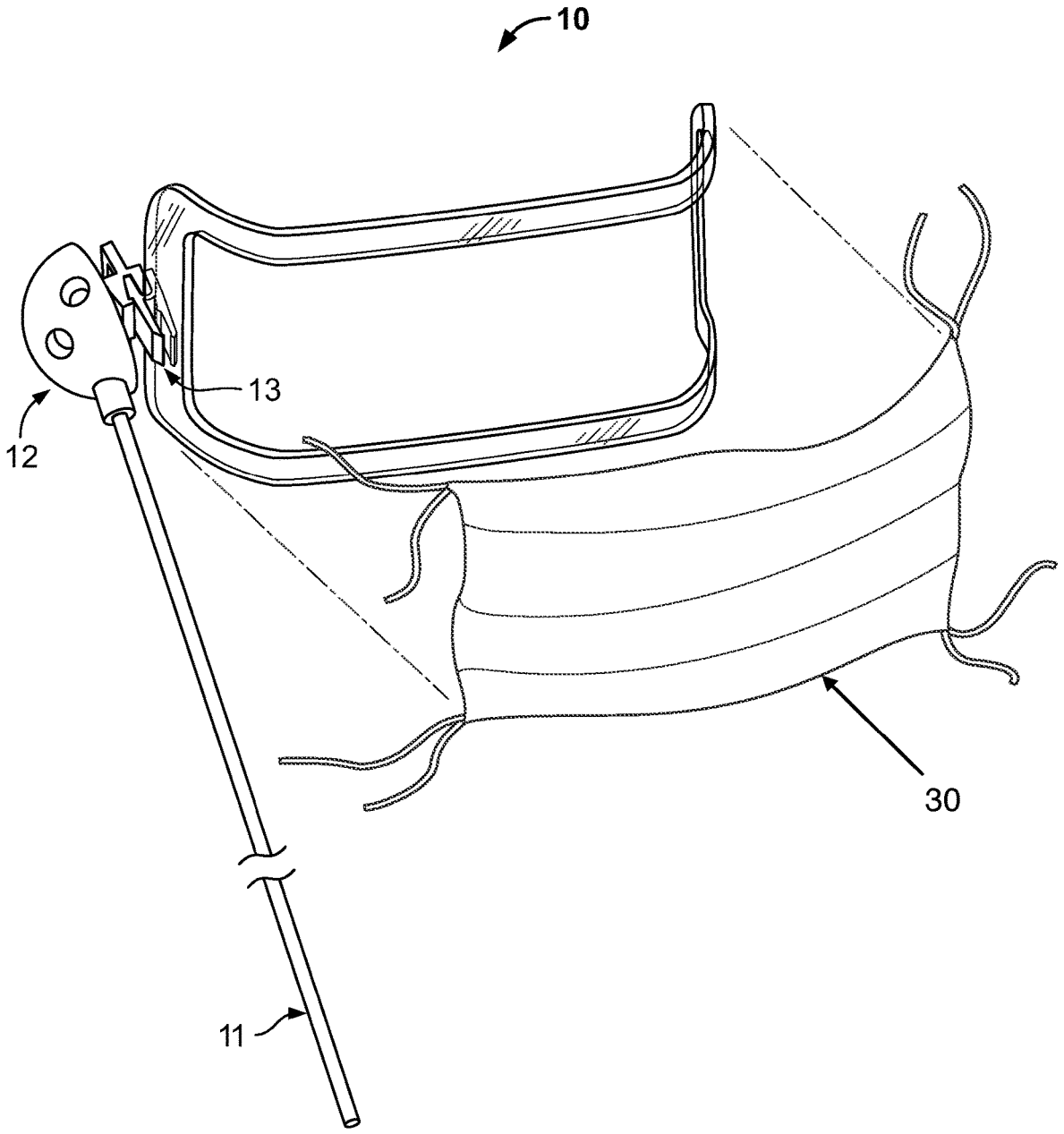
FIG. 5 depicts an exemplary configuration of a handheld demi-face shield utilizing a cloth mask.

In yet another embodiment, handheld demi-face shield device 10 readily accepts cloth mask 30 (see FIG. 5). In another embodiment, cloth mask 30 is removably attached to handheld demi-face shield device 10 by hook and loop tape, clips, and/or ties.

Thus, specific embodiments of a handheld demi-face shield device and the method for using it have been disclosed. It should be apparent, however, to those skilled in the art that additional modifications besides those already described are possible without departing from the inventive concepts herein. Moreover, all terms should be interpreted in the broadest possible manner consistent with the context. In particular, the terms, "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A handheld demi-face shield device comprising:

a demi-shield comprising an outer edge, a first end, a left edge, a right edge, a second end, a bottom portion, and a top portion;

a nose bridge;

a dowel adapter; and a dowel handle, wherein said nose bridge is removably affixed to demi-shield;

wherein dowel adapter comprises a slideable clip, a receiving portion, a face, plurality of dowel holes, and a dowel cuff; and wherein said face is in the shape of a flat circle, and wherein said slideable clip is permanently affixed to said face.

2. The handheld demi-face shield of claim 1, wherein said dowel handle allows a user to adjust the position of said demi-shield on a user's face, and wherein said plurality of dowel holes are configured to allow a user to adjust the angle of said dowel handle to said demi-shield.

3. The handheld demi-face shield of claim 1, wherein said dowel cuff comprises a hollow end and a protruding end wherein said hollow end is capable of receiving said dowel handle and said protruding end is inserted into one of said plurality of dowel holes.

4. The handheld demi-face shield of claim 1, wherein said dowel adapter is removably attached to said left edge of said demi-shield using said slideable clip.

5. The handheld demi-face shield of claim 1, wherein said dowel adapter is removably attached to said right edge of said demi-shield using said slideable clip.

6. The handheld demi-face shield of claim 3, wherein said plurality of dowel holes are configured to accommodate varying diameter of said protruding end.

7. The handheld demi-face shield of claim 1, wherein said slidable clip is configured to engage varying thicknesses of said demi-shield.

8. The handheld demi-face shield of claim 1, wherein said first end is optionally tapered.

9. The handheld demi-face shield of claim 1, wherein said second end is optionally tapered.

10. The handheld demi-face shield of claim 1, wherein said first end and said second end are optionally tapered.

* * * * *